US006105519A

United States Patent [19]

Kastrup

[11] Patent Number: 6,105,519

[45] Date of Patent: Aug. 22, 2000

[54] SEWING MATERIAL CLAMP FOR AN EYELET BUTTONHOLE SEWING MACHINE

[75] Inventor: Eberhard Kastrup, Bielefeld, Germany

[73] Assignee: Dürkopp Adler AG, Germany

[21] Appl. No.: 09/265,034

[22] Filed: Mar. 9, 1999

[30] Foreign Application Priority Data

Mar. 10, 1998 [DE] Germany ..... 198 10 205

[51] Int. Cl.[7] ..... D05B 3/08

[52] U.S. Cl. ..... 112/66; 112/70

[58] Field of Search ..... 112/66, 65, 68, 112/70, 76, 446, 447, 448, 449, 475.25

[56] References Cited

U.S. PATENT DOCUMENTS

| | | | |
|---|---|---|---|
| 5,609,115 | 3/1997 | Ayuta et al. | 112/70 |
| 5,640,917 | 6/1997 | Nii et al. | 112/475.09 X |
| 5,873,314 | 2/1999 | Gamano et al. | 112/66 |

FOREIGN PATENT DOCUMENTS

| | | |
|---|---|---|
| DP 1485196 | 4/1969 | Germany . |
| 1485118 | 8/1969 | Germany . |
| 1660950 | 8/1971 | Germany . |
| 2650334 | 5/1978 | Germany . |
| 3533022 | 3/1986 | Germany . |
| 4132586 | 4/1992 | Germany . |

*Primary Examiner*—Peter Nerbun

*Attorney, Agent, or Firm*—Ostrolenk, Faber, Gerb & Soffen, LLP

[57] ABSTRACT

An eyelet buttonhole sewing machine has a housing with a stand and an arm. A table for carrying an article being sewn is driven in two mutually perpendicular directions (x, y) on the housing. A clamp for the article being sewn is fastened on the table. A needle bar which is mounted in the arm, is driven so as to move up and down and has a needle at its lower end. The clamp for the article being sewn has two arms fastened on a pedestal connected to the table, each arm having a clamping plate provided to bear on the article being sewn. The fastening points of the two arms on the pedestal are substantially adjacent to one another, and both arms are angled in such a manner that their fastening points are offset to the same side of the longitudinal axis of the arm.

10 Claims, 3 Drawing Sheets

SEWING MATERIAL CLAMP FOR AN EYELET BUTTONHOLE SEWING MACHINE

BACKGROUND OF THE INVENTION

The present invention relates to an eyelet buttonhole sewing machine with a housing forming a stand and an arm, a table driven in two mutually perpendicular directions and bearing an article being sewn, a clamp, for the article being sewn, fastened on the table, and a needle bar which is mounted in the arm, which is driven so as to move up and down and has a needle at its lower end.

Such a sewing machine is known, for example, from DE 41 32 586 C2. By means of a clamp for the article being sewn, the article being sewn is fixed on the table which then guides it along under the needle according to the buttonhole bead to be produced. The clamp for the article being sewn is fastened pivotably to the table by a central arm. This arm runs parallel to the longitudinal axis of the sewing machine arm, and further is arranged behind the sewing needle. The article being sewn itself can consequently only be transported over its full length transversely to the machine arm. Therefore, if a great number of buttonholes arranged one following another are to be produced using this sewing machine, this is only possible if the buttonhole bead runs transversely to the longitudinal direction of the article being sewn.

From DE-B 14 85 196, a buttonhole sewing machine is known, which has a great number of machine arms arranged in a parallel manner and at an angle of 45° to the direction of transport of the article being sewn. The machine arms are arranged displaceably along a guide in the direction of transport of the article being sewn. By corresponding displacement or arrangement of the arms along this guide, buttonholes can be produced, which run in both the transverse direction and the longitudinal direction of the edge of the article being sewn or of transport of the article being sewn. It is also possible to produce a combination of buttonholes both parallel to the edge (longitudinal direction) and perpendicular to the edge (transverse direction). On account of the great number of machine arms and their design at an angle of 45°, the construction of this sewing machine is quite complicated. The susceptibility to faults is moreover correspondingly greater in comparison with a machine provided with only one machine arm.

DE-C 16 60 950 discloses an automatic buttonhole sewing machine, in which the stand, to which the arm is fastened, has a recess so that buttonholes running in both the transverse direction and the longitudinal direction can be sewn using this machine. However, no driven table is provided, on which the article being sewn can be fixed. The clamp for the article being sewn is fastened to the arm, so that its fastening point is above the article being sewn and the article being sewn can pass to the recess in the stand.

DE 35 33 022 A1 discloses an eyelet buttonhole sewing machine, in which two clamps arranged symmetrically in relation to the longitudinal axis of the sewing machine arm are provided for securing the article being sewn.

DE 26 50 334 (equivalent to U.S. Pat. No. 4,131,074) and DE 14 85 118 disclose other sewing machines of interest.

SUMMARY OF THE INVENTION

The present invention improves upon the known eyelet buttonhole sewing machines in such a manner that the article being sewn can be transported both in the longitudinal and transverse directions of the sewing machine arm. To solve this problem, the clamp for the article being sewn may have two arms fastened on a pedestal connected to the table, each arm having a clamping plate provided to bear on the article being sewn. The fastening points of both arms on the pedestal are substantially adjacent to one another, and both arms are angled in such a manner that, in relation to the longitudinal axis of the arm, their fastening points are offset to the same side.

As a result of this arrangement, the clamp for the article being sewn allows the article being sewn to pass in the longitudinal direction of the sewing machine arm. With this arrangement, it is therefore possible to produce buttonholes running in both the longitudinal and the transverse directions in relation to the edge of the article being sewn, without having to make any changes to the eyelet buttonhole sewing machine.

Preferably, the pedestal is connected detachably to the table, so that the clamp for the article being sewn is easily exchangeable. This arrangement makes simple adaptation of the sewing machine possible.

In order to bring about the offset of the fastening points to the same side in a simple manner, the arms each comprise a lever arm and a clamping arm fastened adjustably thereon. The clamping plates are fastened to the clamping arms, at the bottom. The lever arms are preferably fastened pivotably to the pedestal, and it is possible to initiate the pivoting movement by means of pneumatic cylinders.

If the clamping plates are spaced so far from one another that the needle can be inserted between them into the article being sewn and the fastening points of the arms are, in relation to the needle insertion point, offset to the same side, the free passage of the article being sewn is also ensured if the needle is mounted outside the longitudinal axis of the machine arm.

Other features and advantages of the present invention will become apparent from the following description of embodiments of the invention which refers to the accompanying drawings.

DETAILED DESCRIPTION OF EMBODIMENTS OF THE INVENTION

Figure 1:
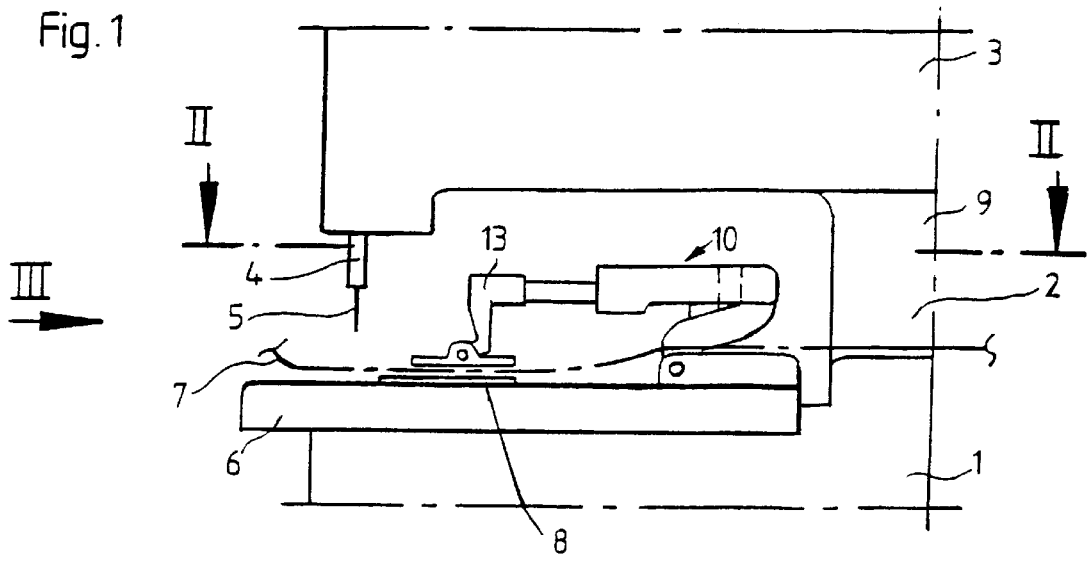
FIG. 1 shows a diagrammatic partial view of a sewing machine.

A sewing machine for producing eyelet buttonholes 24 comprises the base plate 1 and, extending upwardly from this, the stand 2 with the arm 3 fastened to it. The needle bar 4 is mounted in the arm 3 so as to move up and down. At its lower end projecting from the arm 3, the needle bar 4 is provided with the needle 5. In the base plate 1, a table 6 is provided, which is mounted movably in the X direction and the Y direction and has a support 8, on which the article being sewn 7 can be supported. At the end of the table 6 facing the stand 2, a clamp 10 for the article being sewn is arranged, by means of which the article being sewn 7 can be secured on the support 8.

Figure 2:
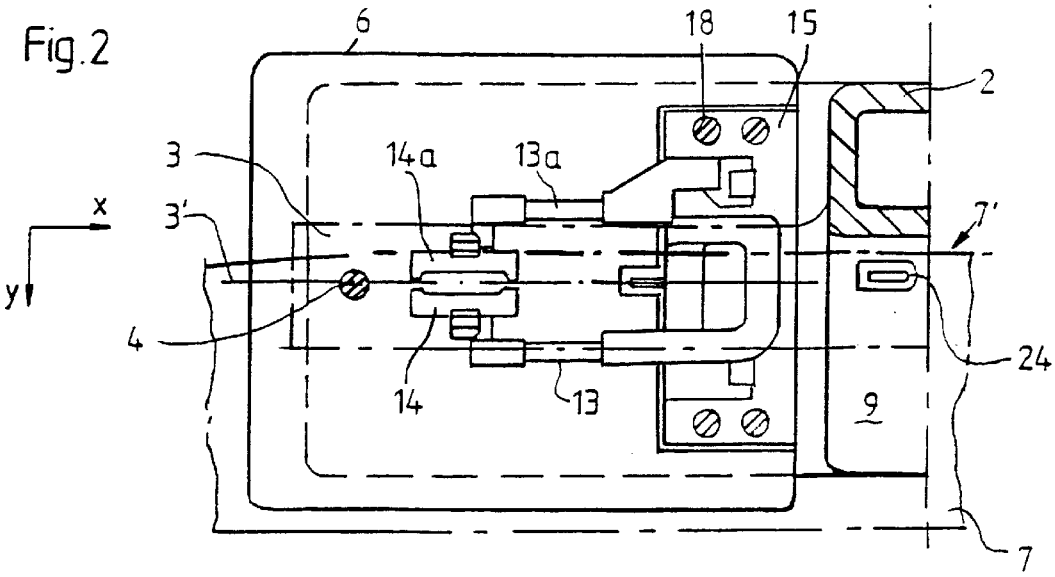
FIG. 2 shows a cross-section taken along the line II—II in FIG. 1.
Figure 3:
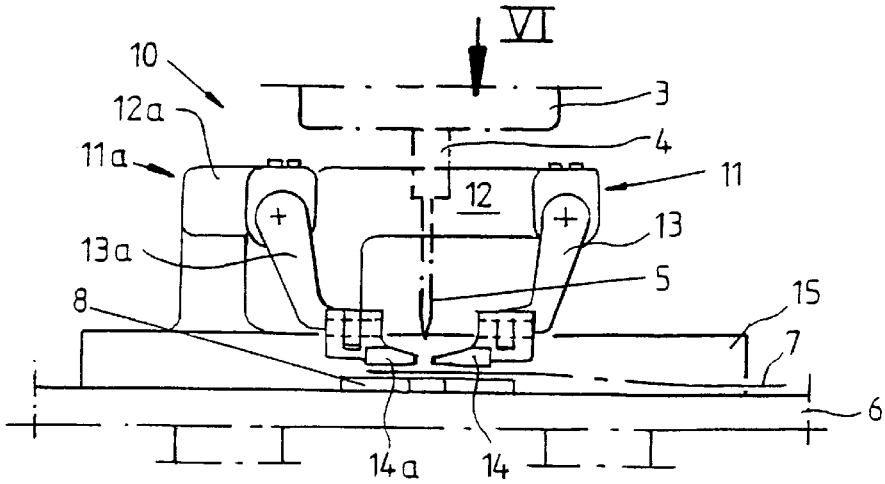
FIG. 3 shows a view taken according to the arrow III in FIG. 1.

The clamp 10 for the article being sewn has two arms 11, 11a which are fastened to a pedestal 15 connected to the table 6. As FIGS. 2 and 3 show, the fastening points of the two arms 11, 11*a* on the pedestal 15 are close to one another, directly adjacent in this embodiment. The arms 11, 11*a* are angled in such a manner that the fastening points are offset to the same side (the left side in FIG. 3) in relation to the longitudinal axis 3' of the arm 3.

The arms 11, 11*a* comprise respective lever arms 12, 12*a* and, arranged on them, corresponding clamping arms 13, 13*a* which have at their lower ends corresponding clamping plates 14, 14*a*, by means of which the article being sewn 7 is fixed on the support 8. The clamping arms 13, 13*a* are connected detachably and adjustably to the lever arms 12, 12*a* by means of screws 16, 16*a*. The lever arms 12, 12*a* are fastened pivotably to the pedestal 15, being pivotable in this embodiment about an axis 15' which is substantially perpendicular to the longitudinal axis 3'.

Each of the lever arms 12, 12*a* is designed with a further lever arm 21, 21*a*. A pneumatic cylinder 20 is connected to the lever arm 21 by means of a detachable driving connection 23 which is known per se. A second pneumatic cylinder of identical design to the pneumatic cylinder 20 is provided in a symmetrical arrangement in relation to the longitudinal axis 3'. The second pneumatic cylinder (not shown) is connected in the same manner to the lever arm 21*a*. Both pneumatic cylinders are arranged firmly on the table 6 under a mounting surface 22 for the pedestal 15. The construction described makes it possible for the clamping arms 13, 13*a* to be positioned in a clamping position and an open position, drawn with solid lines and dot/dash lines, respectively, in FIG. 5.

Figure 4:
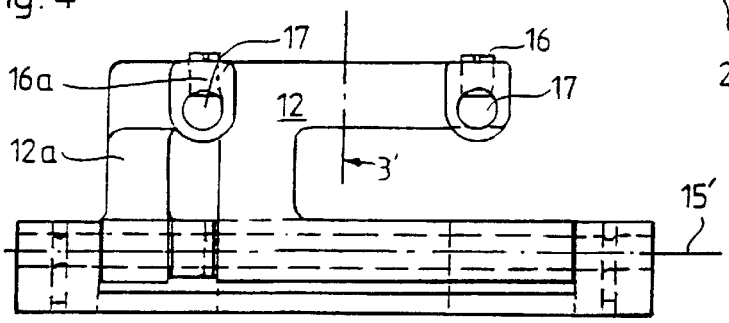
FIG. 4 is a view similar to FIG. 3, showing the lever arms of the clamp for the article being sewn, without the clamping arms inserted.

The clamping arms 13, 13*a* are connected detachably to the lever arms 12, 12*a*. As shown in FIG. 4, the clamping arms 13, 13*a* can be inserted by their round pins 13' into bores 17 extending inside the lever arms 12, 12*a* in the direction of the longitudinal axis 3' and then can be fixed by means of the screws 16, 16*a*. This design makes it possible to provide different clamping arms 13, 13*a* on the clamp 10 for the article being sewn. For secure fixing of the clamping arms 13, 13*a*, the round pins 13' are provided with grooves 25 running in the axial direction. This design prevents the clamping arms 13, 13*a* from turning in the bores 17. The pedestal 15 is connected detachably to the table 6 by means of screws 18.

Figure 5:
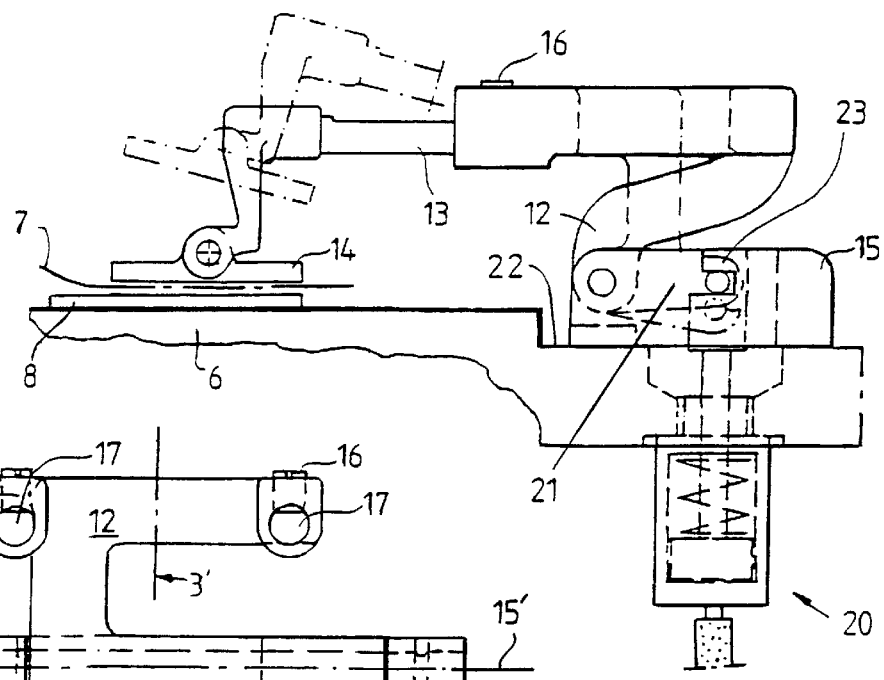
FIG. 5 is an enlarged view corresponding to part of the view according to FIG. 1.

As shown clearly in FIG. 2 and FIG. 5, the lever arm 12 first runs upwardly and then laterally at an angle and rises in front of the recess 9 provided in the stand 2. In this way, the clamp 10 for the article being sewn allows the article being sewn 7 to pass through in the direction of the longitudinal axis 3', so that buttonholes 24 with buttonhole beads which run in the longitudinal direction in relation to the edge 7' of the article being sewn 7 can be produced using the sewing machine.

Figure 6:
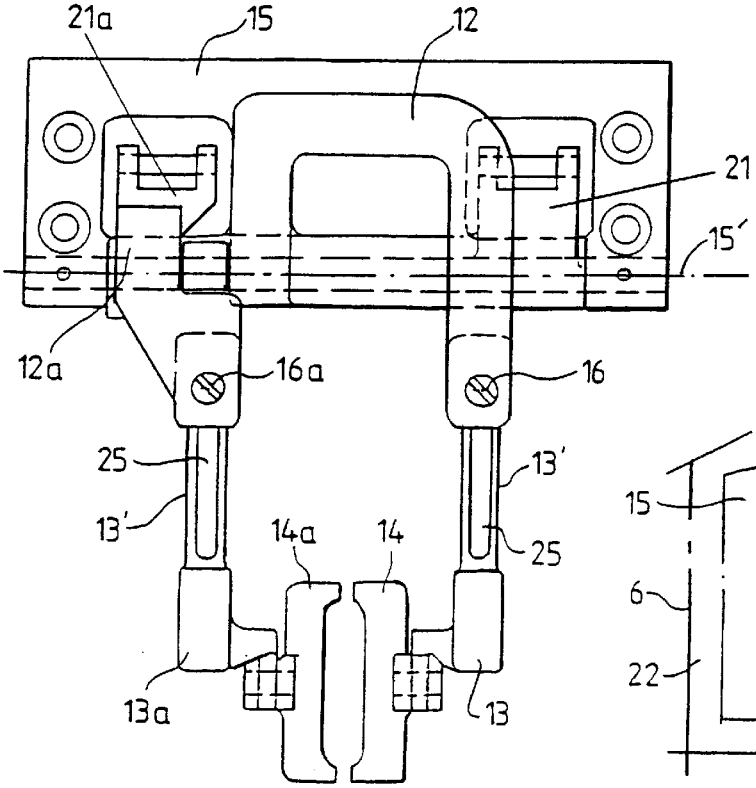
FIG. 6 is a view taken according to the arrow VI in FIG. 3 of the clamp for the article being sewn.
Figure 7:
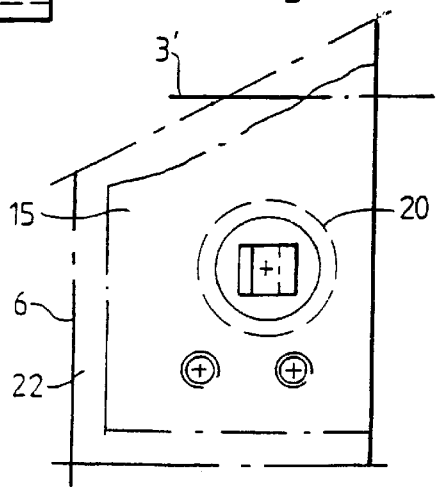
FIG. 7 shows a top view of the mounting surface for the pedestal.
Figure 8:
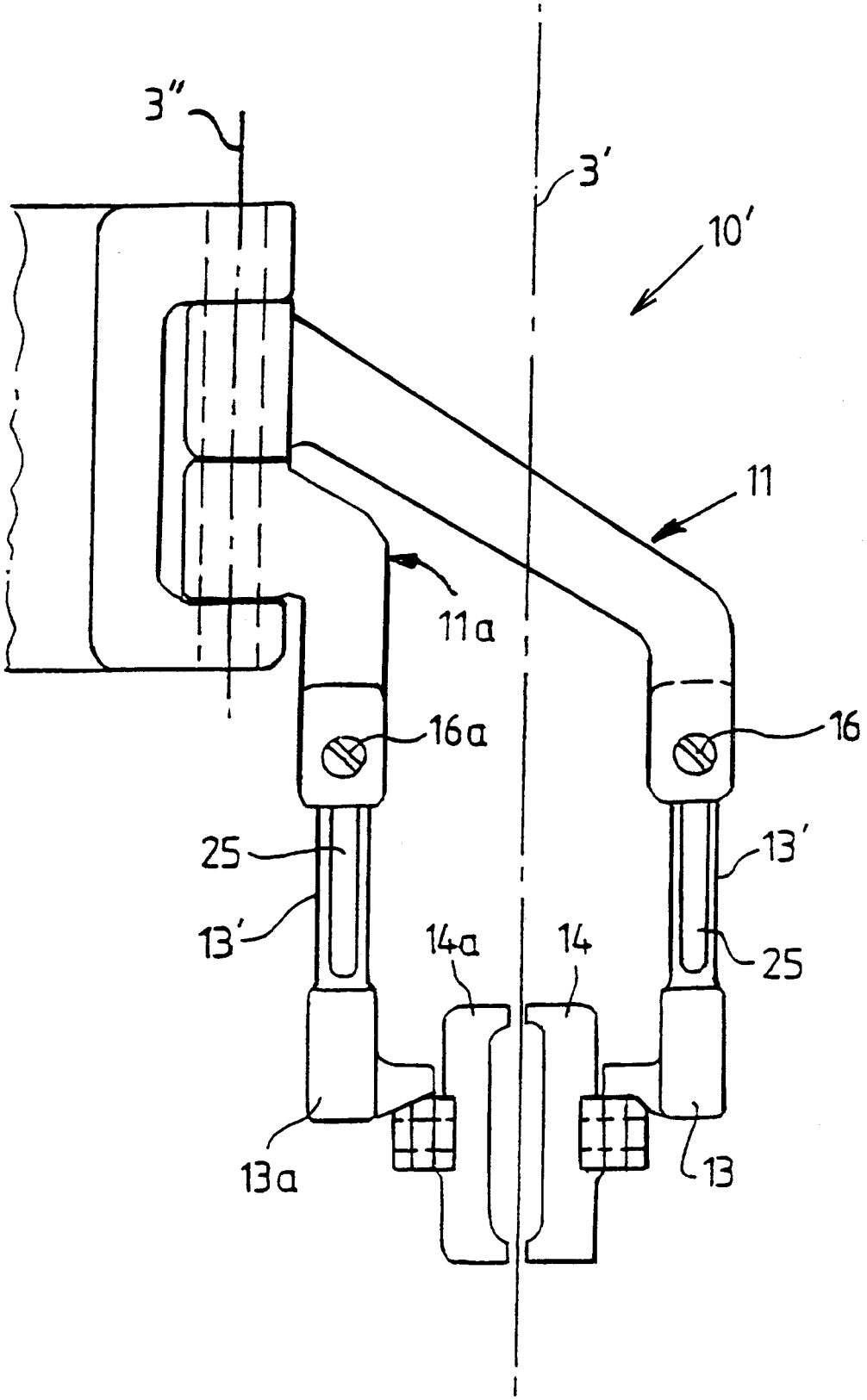
FIG. 8 is a view similar to FIG. 6 showing a further exemplary embodiment of a clamp for the article being sewn.

FIG. 8 shows another exemplary embodiment of a clamp 10' for the article being sewn, which allows the article being sewn 7 to pass through in the direction of the longitudinal axis 3', as in the embodiment of FIG. 6. However, in contrast to the clamp shown in FIG. 6, the present embodiment has arms 11, 11*a* which are pivotable about a common longitudinal axis 3" which is substantially parallel to the longitudinal axis 3', unlike the embodiment of FIG. 6 in which the arms 12, 12*a* are pivotable about an axis which is substantially perpendicular to the longitudinal axis 3'.

Although the present invention has been described in relation to particular embodiments thereof, many other variations and modifications and other uses will become apparent to those skilled in the art. Therefore, the present invention is not limited by the specific disclosure herein.

What is claimed is:

1. An eyelet buttonhole sewing machine comprising:

a housing, which includes a base, a stand and an arm, the arm having a longitudinal axis;

a table mounted on the base and being drivable for carrying an article to be sewn;

a needle bar mounted in the arm, having a needle at a lower end and being drivable up and down; and a clamp mounted on the table for holding the article to be sewn, wherein the clamp for the article to be sewn has two clamp arms fastened to the table, each clamp arm having a respective clamping portion arranged for bearing on the article to be sewn, and respective fastening points of the two clamp arms on the table are both offset to a same side of the longitudinal axis of the sewing machine arm.

2. The eyelet buttonhole sewing machine as claimed in claim 1, wherein said clamp arms are fastened on a pedestal which is connected detachably to the table.

3. The eyelet buttonhole sewing machine as claimed in claim 1, wherein the clamp arms each comprise a respective lever arm and a corresponding clamping arm fastened adjustably thereon, said clamping portion being at a distal end of said clamping arm.

4. The eyelet buttonhole sewing machine as claimed in claim 3, wherein the lever arms are fastened pivotably to the table.

5. The eyelet buttonhole sewing machine as claimed in claim 4, further comprising respective actuators for initiating the pivoting movement of the lever arms.

6. The eyelet buttonhole sewing machine as claimed in claim 5, wherein said actuators are pneumatic cylinders.

7. The eyelet buttonhole sewing machine as claimed in claim 4, wherein the lever arms are pivotable about a pivot axis which is substantially parallel to the longitudinal axis of the sewing machine arm.

8. The eyelet buttonhole sewing machine as claimed in claim 4, wherein the lever arms are pivotable about a pivot axis which is transverse to the longitudinal axis of the sewing machine arm.

9. The eyelet buttonhole sewing machine as claimed in claim 8, wherein said pivot axis is substantially perpendicular to the longitudinal axis of the arm.

10. The eyelet buttonhole sewing machine as claimed in claim 1, wherein said clamp arms are disposed with respect to the longitudinal axis of the sewing machine arm such that the needle can pass between said clamping portions.

* * * * *